US007220916B2

(12) United States Patent
Schwamborn et al.

(10) Patent No.: US 7,220,916 B2
(45) Date of Patent: May 22, 2007

(54) ELECTRIC HEATING CABLE OR TAPE HAVING INSULATING SHEATHS THAT ARE ARRANGED IN A LAYERED STRUCTURE

(75) Inventors: Klaus Schwamborn, Wipperfürth (DE); Wolfgang Dlugas, Wipperfürth (DE)

(73) Assignee: Hew-Kabel/CDT GmbH & Co: KG, Wipperfuerth (DE)

( * ) Notice: Subject to any disclaimer, the term of this patent is extended or adjusted under 35 U.S.C. 154(b) by 0 days.

(21) Appl. No.: 10/859,174

(22) Filed: Jun. 3, 2004

(65) Prior Publication Data

US 2005/0016757 A1 Jan. 27, 2005

(30) Foreign Application Priority Data

Jun. 5, 2003 (DE) ..... 103 25 517

(51) Int. Cl.
*H01B 7/00* (2006.01)

(52) U.S. Cl. ..... 174/110 R; 174/120 R; 174/120 C

(58) Field of Classification Search ..... 174/102 R, 174/105, 106 R, 108, 113 R, 117 R, 117 F, 174/117 FF, 120 R
See application file for complete search history.

(56) References Cited

U.S. PATENT DOCUMENTS 4,345,368 A * 8/1982 Goss et al. ..... 29/611
4,523,086 A * 6/1985 Eilentropp ..... 219/549
4,629,869 A * 12/1986 Bronnvall ..... 219/553
4,816,649 A * 3/1989 Eilentroop ..... 219/549
5,002,359 A * 3/1991 Sayegh ..... 385/107
5,025,115 A * 6/1991 Sayegh et al. ..... 174/117 F
5,061,823 A * 10/1991 Carroll ..... 174/105 R
5,558,794 A * 9/1996 Jansens ..... 219/549
5,560,986 A * 10/1996 Mortimer, Jr. ..... 428/308.4
6,144,018 A * 11/2000 Heizer ..... 219/529
6,337,443 B1 * 1/2002 Dlugas et al. ..... 174/120 R
2002/0062984 A1 * 5/2002 Dlugas ..... 174/120 R

FOREIGN PATENT DOCUMENTS

| | | | |
|---|---|---|---|
| DE | 28 50 722 | A1 | 5/1980 |
| DE | 32 33 904 | A1 | 3/1984 |
| DE | 32 43 061 | A1 | 5/1984 |
| DE | 200 06 222 | U1 | 8/2000 |
| DE | 101 07 429 | A1 | 9/2002 |
| EP | 0 609 771 | B1 | 8/1994 |
| GB | 2 092 420 | A | 8/1982 |
| GB | 2 130 459 | A * | 5/1984 |

* cited by examiner

*Primary Examiner*—William H. Mayo, III
(74) *Attorney, Agent, or Firm*—Birch, Stewart, Kolasch & Birch, LLP

(57) ABSTRACT

An electric heating cable or an electric heating tape having insulating sheaths of polytetrafluoroethylene (PTFE) being arranged in a layered structure is provided. At least one of the PTFE sheaths is protected by at least one adjacent insulating layer of a melt processable fluoropolymer.

23 Claims, 2 Drawing Sheets

Fig.1
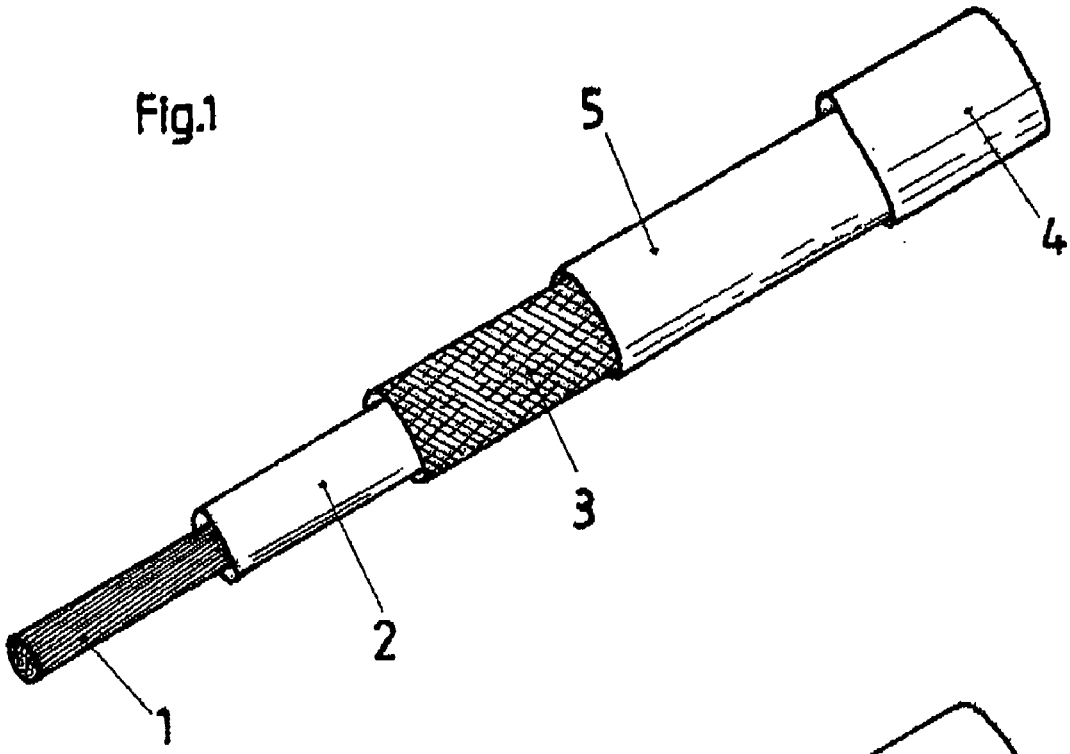
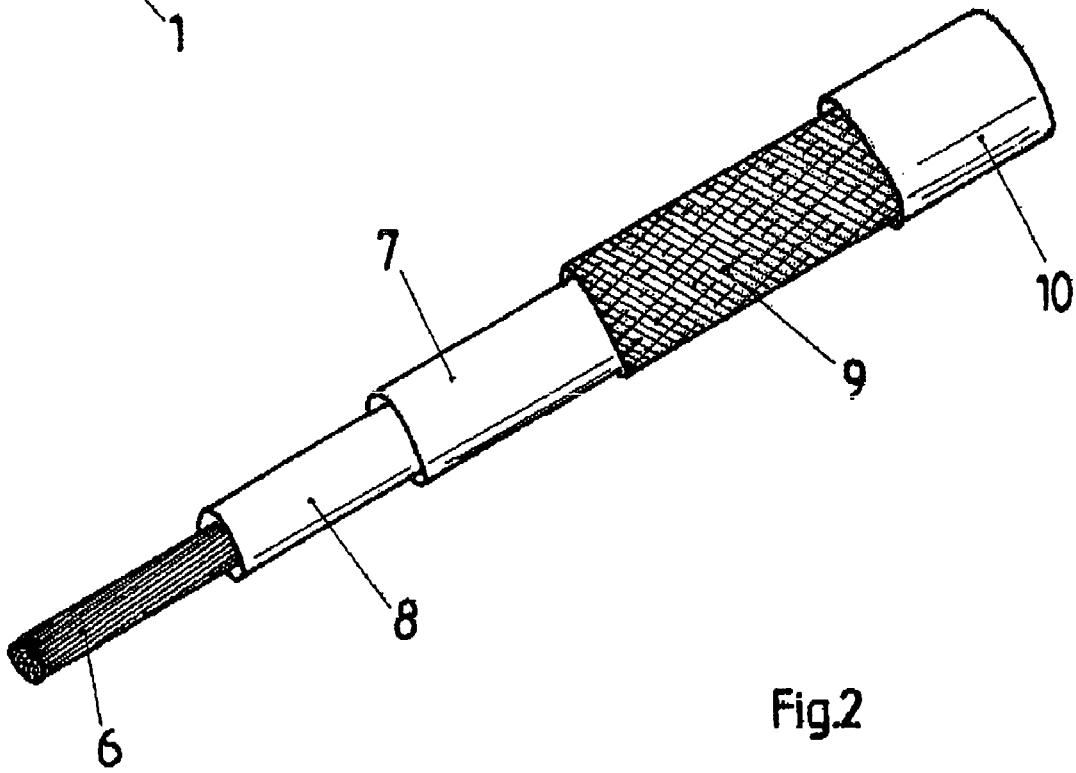
Fig.2

ELECTRIC HEATING CABLE OR TAPE HAVING INSULATING SHEATHS THAT ARE ARRANGED IN A LAYERED STRUCTURE

This nonprovisional application claims priority under 35 U.S.C. § 119(a) on German Patent Application No. 103 25 517.6 filed in Germany on Jun. 5, 2003, which is herein incorporated by reference.

BACKGROUND OF THE INVENTION

1. Field of the Invention

The present invention relates to an electric heating cable or an electric heating tape having insulating sheaths of polytetrafluoroethylene that are arranged in a layered structure.

2. Description of the Background Art

Heating cables in a coaxial arrangement, wherein the heat conductor is enclosed by a fluoropolymer as insulating material, are known (DE-A 28 50 722) for a very wide range of applications, for example including the heating of aggressive media. This insulation is covered by a copper wire braid, where the individual copper wires are additionally nickel-plated for corrosion resistance. This braid of copper wires is the electrical ground conductor for the cable, which is provided in the cable to preclude the risk of accidents, for example resulting from such causes as short circuits in the electrically conductive part. The ground conductor is covered by an outside plastic jacket that is made, for example, of a fluoropolymer to protect against aggressive media in the environment. The advantage of a coaxial arrangement structured in this way, in addition to the wide range of applications for this cable that result from the use of materials resistant to high temperatures and aggressive media, is that such cables can be manufactured in almost any desired length with great flexibility.

The same is true for known electric heating tapes (GB 2 092 420 A, GB 2 130 459 A), which are used for example for pipe heaters, and also on steam-cleaned pipes to maintain or raise the temperature. Lastly, so-called self-regulating heating tapes with a semiconductor heating element are also in use. Since the emission of heat is automatically controlled here as a function of the ambient temperature, such heating tapes are especially suitable for use in areas where explosion hazards exist.

However, when heating cables are used as, for example, coaxial types, it frequently happens that the outer jacket is so severely crushed by external forces so that the insulation is forced away from the heating conductor, that either the ground conductor and heating conductor contact one another or that the insulating distance between the heating and ground conductors has become so small that corona or spark discharges occur. Moreover, the damage can cause broken wires of the ground conductor to penetrate the insulation and thus lead to failure of the entire heating cable. These criteria must be paid particular attention in heating cables that are used in explosion-proof systems and that are thus subject to special safety requirements as preventive explosion protection. However, these criteria must also be taken into account with regard to applicable standards (DIN VDE 0170/0171, EN 50014 and EN 50019), which for example require a ground conductor that ensures adequate coverage of the surface of the conductor insulation as well as separate crush testing followed by testing of the insulating properties of the conductor insulation. Increasing the wall thickness of both the insulation and the outer jacket to avoid these problems provides no additional benefit here; moreover, these measures significantly increase the diameter of the cable as a whole and also increase costs due to the larger quantity of fluoroplastic used.

An electric heating cable with a coaxial layered structure that is resistant to external mechanical stresses is known from, for example, DE-ES 101 07 429. A glass ceramic tape layer in the layer structure above the conductor insulation of this cable is intended to offer protection from external mechanical damage in conjunction with a similarly air-permeable reinforcing layer. Air-impermeable layers of an extrudable fluoropolymer are provided on both sides of these two layers so that an air cushion can form between them. Aside from this costly layered construction, which also increases the cable diameter, the intentionally created air cushion inside the cable leads to significant impairment in the conduction of heat away from the heating conductor to the cable surface, and thus to degradation of the efficiency of the heating cable itself.

In order to avoid this but still satisfy the requirements of the applicable standards for adequate resistance to external impact and compressive stresses, it has already been proposed (EP 0 609 771 B1) to provide one or more layers of a tape made of plastics having high mechanical strength, such as polyimide, above and/or below the ground conductor in an electrical heating cable of the generic type. Such a wrapping is capable of withstanding high compressive stresses, external impacts are absorbed in a dammed manner, and damage to the conductor insulation is avoided.

SUMMARY OF THE INVENTION

It is therefore an object of the present invention to protect the polytetrafluoroethylene sheaths (conductor insulation, intermediate jacket, outer protective jacket) that are present in the layered structure of a heating cable or heating tape, even under the application of extreme mechanical forces resulting from impact or crushing stresses.

In accordance with the invention., at least one of the polytetrafluoroethylene sheaths is protected against shock by at least one adjacent insulating layer made of a melt processable fluoropolymer. In this context, the invention proceeds from the knowledge that adequate protection from external mechanical stresses can be achieved by the juxtaposition of polymer layers from the same polymer family but with different polymer structures. Thus, as proposed by the invention, polytetrafluoroethylene with its fibrous polymer structure having so-called fibrils is protected by the adjacent thermoplastic polymer with its amorphous structure. This results from the fact that, in contrast to the fiber structure, the amorphous polymer structure has a shock-absorbing action under shock or impact stresses.

An advantageous embodiment of the present invention results in an electric heating cable in a coaxial arrangement having a central conductor, an insulation made of polytetrafluoroethylene, a ground conductor in the form of twisted or woven wires, and an outer protective jacket when the polytetrafluoroethylene insulation, in one or more layers, is protected against shock by at least one adjacent insulating layer of a melt processable fluoropolymer.

An especially advantageous embodiment of a heating cable in a coaxial arrangement results in accordance with the invention when the shock-absorbing insulating layer of melt processable fluoropolymer is placed beneath the polytetrafluoroethylene insulation enclosing the conductor, and hence directly on the conductor itself. The use of materials of related type for mechanical protection, too, significantly increases long-term thermal stability, a necessary property for heating cables, over known heating cables or wires. The heating cable in accordance with the invention has no air cushions in the layer structure, so the heat generated by the conductor reaches the cable/wire surface, which is to say where it is needed, without significant heat build-up. The cable structure poses no manufacturing difficulties, and the cable diameter can be kept small due to the extruded polymer protection layers.

Since polytetrafluoroethylene insulation generally undergoes heat treatment for sintering the polymer material, the resulting shrinkage of the polytetrafluoroethylene compacts the layer structure. Consequently, in contrast to prior art heating cables with air cushions, the cable is longitudinally waterproof, while prior art glass-fiber cloth, mica tape or inorganic films also have an undesirable picking action and thus provide for ideal moisture transport.

As discussed above, an extremely wide variety of electric heating tapes are in use in addition to the coaxial heating cables described. For example, if such a heating tape includes parallel supply wires and a heater spiral that contacts the conductors of said supply wires at intervals, as well as an intermediate jacket and/or an outer jacket of polytetrafluoroethylene, then in execution of the invention at least one jacket layer is protected against shock by at least one adjacent insulating layer of a melt processable fluoropolymer.

In a further embodiment, the heating tape has parallel, uninsulated supply conductors and a heater wire that runs parallel to the supply conductors and contacts them at intervals, and has a common polytetrafluoroethylene sheath, in accordance with the invention the sheath is protected against shock by at least one adjacent insulating layer of the melt processable fluoropolymer.

Self-regulating heating tapes have proven advantageous for special applications, for example in explosion protection. In these heating tapes, which have parallel, uninsulated supply conductors, a semi conducting sheath surrounds them and a common insulation and/or an outer protective jacket of polytetrafluoroethylene. The common insulation and/or protective jacket is/are in turn protected against shock in accordance with the invention.

In a further embodiment of the invention, the goals of longitudinal waterproofed and compactness of the heating cables or heating tapes in accordance with the invention are also served by welding or adhesive bonding of the shock absorbing insulating layers to the polytetrafluoroethylene sheaths. At the same time, the bending-fatigue strength of such arrangements is significantly increased.

The thickness of the shock-absorbing layer can be 0.1 to 0.8 mm, preferably 0.2 to 0.5 mm. In the case of heating cables in a coaxial arrangement and with a shock-absorbing insulating layer directly on the conductor, the thickness chosen depends largely on the conductor diameter involved. Thus, for example, the shock-absorbing layer for a conductor diameter of 1.5 mm is 0.2 mm.

The invention also offers particular advantages when the conductor insulation has a polytetrafluoroethylene tape wrapped with overlapping edges, for instance with a rectangular cross-section. In this case, the inters paces formed by the winding of the tape are filled, in accordance with the invention, with the fluoropolymer of the shock-absorbing layer. The adhesion of adjacent layers is improved, and the further compactness thus achieved ensures great stability of the cable with respect to bending and kinking.

In accordance with the invention the shock-absorbing layer can be made of a melt processable fluoropolymer. Since great long-term thermal stability is also important for a generic heating cable or heating tape on account of its purpose, including under the influence of aggressive media in certain circumstances, it can be advantageous to manufacture the shock-absorbing layer of a tetrafluoroethylene/perfluoroalkoxy copolymer (TFA/PFA). But tetrafluoroethylene/hexafluoropropylene copolymer (FEP) and polytetrafluoroethylene/perfluoromethyl vinyl ether copolymer, also known by the trade name HYFLON MFA, are also advantageous polymers for carrying out the invention, depending on the area of application.

Other known melt processable fluoropolymers, such as polyvinyl difluoride (PVDF) or ethylene-tetrafluoroethylene (ETFE) may also find advantageous application on occasion.

An especially advantageous embodiment of the invention results with a polytetrafluoroethylene sheath made of a wrapped polytetrafluoroethylene tape when the tape has a planoconvex cross-section. As compared to ordinary tapes with rectangular cross-sections, after wrapping and sintering of the polytetrafluoroethylene tape the planoconvex shape produces a compact sheath with a continuous, smooth outer surface. This is particularly advantageous when the outer surface is exposed to aggressive media in the environment.

Another advantageous possibility for improving the insulation quality as compared to that of rectangular tapes is to design the tape of polytetrafluoroethylene with a flat cross-sectional profile having edge regions tapering from the center to both sides and uniform at the edges. Once the tape has been wrapped with overlapping edges and the tape material (PTFE) has been sintered, the tapering of the tape edges into the overlap area results in an especially smooth, continuous insulator surface. It is advantageous in this context for the edges of the polytetrafluoroethylene tape to be wide, with the edge width on both sides of the central region that determines the tape thickness being at least 45%, preferably 50% to 80%, of the total width of the tape.

The thickness of the polytetrafluoroethylene tape advantageously used in accordance with the invention is 20 to 200 μm, preferably 40 to 160 μm. The tape thickness decreases toward the edges (border) to 5 μm and less. It is useful here for the tape width to be 5 to 50 mm, preferably 10 to 30 mm.

The same tape dimensions has a particular advantage for the case where, in addition to the insulation, the outer protective jacket is also made of a wrapped polytetrafluoroethylene tape.

In this case it can sometimes be advantageous to arrange a shock-absorbing insulating layer of melt processable fluoropolymer beneath the wrapped layer(s) of polytetrafluoroethylene. Another advantageous embodiment of the invention would be to have a shock-absorbing insulating layer of melt processable fluoropolymer adjacent to the ground conductor on one or both sides to enclose the ground conductor with these insulating layers.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 1 shows a heating cable according to a preferred embodiment of the present invention;

FIG. 2 shows a heating cable according to an alternate embodiment of the present invention;

DETAILED DESCRIPTION

Figure 3:
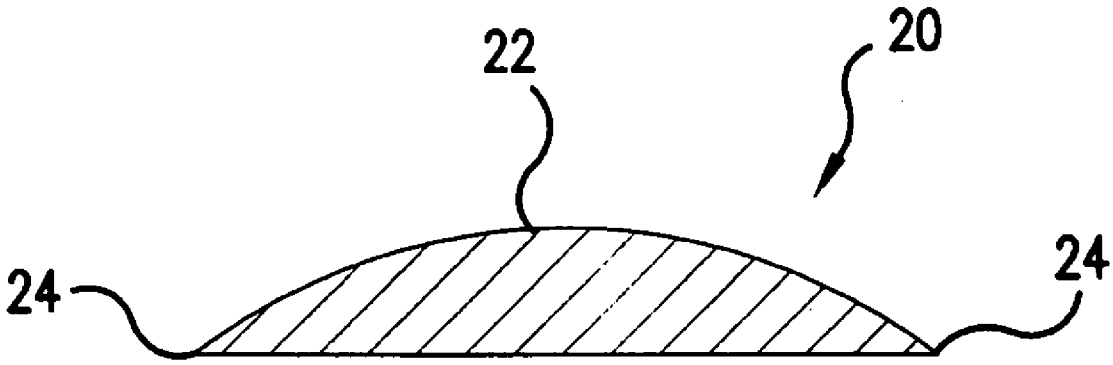
FIG. 3 is an outline of the cross-sectional shape of an electric heating tape according to an embodiment of the present invention.

To increase the flexibility of the heating cable in accordance with the invention, a conductor 1 includes, for example, a number of individual resistance wires, as shown in FIG. 1. A conductor insulation is labeled 2, and has a high-temperature resistant polytetrafluoroethylene, where the term "polytetrafluoroethylene"—as above—also includes tetrafluoroethylene polymers provided with modifying additives, although not in such quantities that the polymer is not melt processable as PTFE itself.

In a preferred embodiment of the invention, the polytetrafluoroethylene, which is used, has an initially unsintered tape or film material, which is wrapped in the unsintered state about the heat conductor, preferably with an overlap, for example of up to 50%, and is then sintered in the wrapped state by an appropriate heat treatment. In this process, the individual tape layers are melted or fused to a compact insulation.

A ground conductor 3 includes individual metallic wires, for example, nickel-plated copper wires, which are twisted onto, or—to create the greatest possible coverage extending around the circumference—woven onto the conductor insulation 2.

The heating cable is sealed to the outside by a jacket 4, which it is beneficial to manufacture of a suitably appropriate plastic material since such cables are sometimes used in areas subject to the influence of aggressive media, for example, in the chemical industry. Fluoropolymers have likewise proven their worth as jacket materials, which are applied in extruded form or in that the external border of the heating cable is comprised of a winding of initially unsintered PTFE tape which is then sintered in the wrapped state.

Now in order to prevent the jacket 4 from being crushed and/or forced away from the ground conductor 3 in the event of external compressive loading (impact), which is to say to prevent damage to the heating cable and possibly also cable failures, a shock-absorbing layer 5 is provided beneath the jacket 4. This layer can be made of an amorphous, extrudable fluoropolymer, and dampens impact energy that is applied from the outside, thus preventing damage or destruction of the cable.

An especially advantageous embodiment of the invention is shown in FIG. 2. The heating cable, again in a coaxial design, includes a heat conductor 6, for example a plurality of individual resistance wires twisted or woven together. A conductor insulation is labeled 7, and can have one or more layers of a tape made of polytetrafluoroethylene (PTFE). While this tape, which is applied in the unsintered state by wrapping and then sintered in the wrapped state, does form—after sintering—a compact, longitudinally waterproof sleeve that is even resistant to aggressive media, but because of the material structure it may not be able to adequately withstand shock or impact stresses without damage. In order to make this heating cable fit for use under extreme external stresses as well, so that it may also be used in explosion-proof (potentially explosive) systems for example, a shock absorbing layer 8 of a melt processable fluoropolymer is provided. This layer directly covers the conductor 6; because the diameter of the conductor is smaller in relation to the diameter of the cable, the wall thickness of the layer 8 may be kept extremely thin. There is a significant savings in polymer material as compared to the solution shown in FIG. 1, and moreover this embodiment produces a smaller total diameter as compared to the above example embodiment, but even more importantly as compared to the prior art.

The layer 8, which because of its material structure, functions essentially as a resilient buffer layer under the influence of impact on the cable, and mechanically protects the adjacent conductor insulation 7. The insulation is not crushed or forced away from the conductor 6, and its insulating effect is maintained. An external impact is absorbed in a dammed manner, and there is no danger of damage to the conductor insulation 7. This cable structure in accordance with the invention significantly enhances the material-specific properties of PTFE and PFA (TFA, MFA). For example the greater hardness of PTFE coupled with the greater elasticity of PFA produces a significant increase in the compressive and impact load resistance or stability in this composite structure.

Since the substructure remains undamaged under the influence of shock or impact, there is also no danger of a wire break within the ground conductor 9 or a failure of the cable due to broken wires which could penetrate a damaged insulation 7. Consequently, the heating cable according to the invention fulfills all safety requirements, in particular also those for explosion protection. Furthermore, this heating cable in accordance with the invention is economical to manufacture, in part because of the simplified process steps as compared to the prior art, and in part because of the smaller quantities of materials, which moreover belong to the same polymer family. This is of particular advantage when high long-term thermal stability is required, for example in superheated steam cleaning systems having operating temperatures between 300° and 320° C.

In this example embodiment, the outside jacket 10 again has a wrapping of PTFE tapes, which in the wrapped state, are subjected to a heat treatment, and thus are welded or fused into a compact sheath. The special cross-sectional shape of the PTFE tape provided in accordance with the invention produces an especially smooth, continuous surface. Tearing of the individual tape layers under shock or impact loads is prevented by the solution according to the invention of arranging a shock-absorbing polymer layer from the same polymer family in the layered construction of the heating cable.

The heating cable according to the invention shown in FIG. 2 is also characterized by especially advantageous outside dimensions. With a total diameter of 4.8 mm, for example, the diameter of the conductor 6 can be 1.4 mm, the wall thickness of the shock-absorbing layer 8 can be 0.2 mm, the insulation 7 can have a wall thickness of 0.6 mm, the thickness of the braid 9 can be 0.4 mm, and the jacket 10 has a wall thickness of 0.5 mm.

Other variants deviating from the preferred embodiment shown in FIG. 2 are also possible. Thus, for example, insulating layers of PTFE and PFA may alternate in the layer construction of the heating cable, for instance PTFE/PFA/

PTFE or PFA/PTFE/PFA, with the prerequisite as in the example embodiments that these insulating layers must adjoin one another.

The effect according to the invention can also be achieved when, in contrast to the example embodiments shown, prior art heating cables or heating tapes—even in embodiments deviating from the coaxial construction—are to be made fit to withstand shock and compressive stresses, and insulating layers of melt processable fluoropolymers according to the invention adjoin the PTFE sheath used therein.

Figure 4:
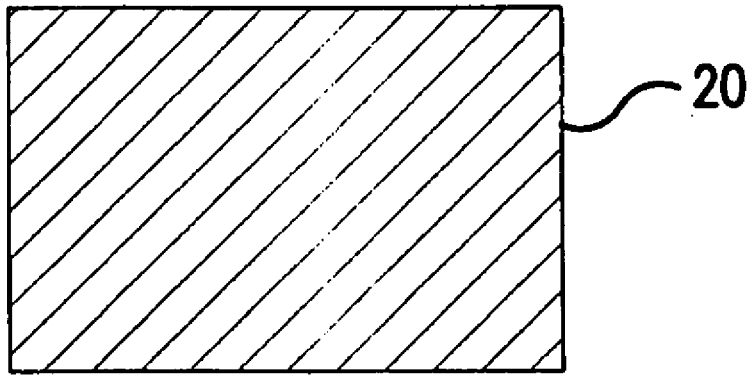
FIG. 4 is an outline of the cross-sectional shape of an electric heating tape according to an embodiment of the present invention.

FIG. 3 shows an outline of the cross-sectional shape of the electrical heating tape 20 having a planoconvex cross-section, whereby the tape 20 tapers from a center 22 to edges 24. FIG. 4 is an outline of the cross-sectional shape of the electrical heating tape 20 having a rectangular shaped cross-section according to an alternate embodiment of the present invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A shock-protected coaxial electric heating cable having a longitudinal central axis with an electric resistance heating conductor located along the longitudinal central axis for generating heat, and insulating sheaths of polytetrafluoroethylene being arranged in a layered structure with respect to each other and with respect to the heating conductor, wherein at least one of the polytetrafluoroethylene sheaths is protected against shock by at least one adjacent insulating layer means made of a melt processable fluoropolymer, the at least one adjacent insulating layer means being in surface contact to the at least one of the polytetrafluoroethylene sheaths for conducting heat to the cable surface and for providing shock protection around the heating cable;

wherein the heating cable has no air cushions in the layer structure to reduce heat generated by the electric resistance heating conductor from building up in the cable on its way to the cable surface.

2. The electric heating cable according to claim 1, wherein the electric heating cable further comprises a ground conductor in the form of twisted or woven metal wires, and an outer protective jacket, wherein the polytetrafluoroethylene insulation, in one or more layers, is protected against shock by at least one adjacent insulating layer of a melt processable fluoropolymer.

3. The electric heating cable according to claim 2, wherein a single-layer insulation of polytetrafluoroethylene encloses the heating conductor and the ground conductor, and an outer protective jacket covers the single-layer insulation, and wherein a shock-absorbing insulating layer of melt processable fluoropolymer is placed beneath the polytetrafluoroethylene insulation and directly on the heating conductor itself.

4. The electric heating cable according to claim 2, wherein the thickness of the shock-absorbing insulating layer is 0.1 to 0.8 mm.

5. The electric heating cable according to claim 2, wherein the outer protective jacket includes a wrapped polytetrafluoroethylene tape.

6. The electric heating cable according to claim 5, wherein the shock-protecting insulating layer of melt processable fluoropolymer is placed beneath the layer of polytetrafluoroethylene insulation.

7. The electric heating cable according to claim 2, wherein the shock-protecting insulating layer of melt processable fluoropolymer is adjacent to a ground conductor on one or both sides.

8. The electric heating cable according to claim 2, wherein the thickness of the shock-protecting insulating layer is 0.2 to 0.5 mm, depending on a diameter of the conductor involved.

9. The electric heating cable according to claim 1, wherein the shock-absorbing insulating layer is welded or adhesive bonded to the polytetrafluoroethylene sheath.

10. The electric heating cable according to claim 1, wherein the sheath of a polytetrafluoroethylene tape is wrapped with overlapping edges, and wherein the interspaces formed by the winding of the tape are filled with the fluoropolymer of the shock-absorbing layer.

11. The electric heating cable according to claim 10, wherein the tape of polytetrafluoroethylene has a rectangular shaped cross-section.

12. The electric heating cable according to claim 10, wherein the tape of polytetrafluoroethylene has a planoconvex cross-section.

13. The electric heating cable according to claim 10, wherein the tape of polytetrafluoroethylene is designed with a flat cross-sectional profile having edge regions tapering from a center to each edge and is uniform at the edges.

14. The electric heating cable according to claim 13, wherein an edge width of the edge regions on both sides of a central region is at least 45% of the total width of the tape.

15. The electric heating cable according to claim 13, wherein the polytetrafluoroethylene tape has a thickness of 20 to 200 μm, which decreases toward the edge regions to 5 μm or less.

16. The electric heating cable according to claim 15, wherein the width of the polytetrafluoroethylene tape is 5 to 50 mm.

17. The electric heating cable according to claim 15, wherein the width of the polytetrafluoroethylene tape is 10 to 30 mm.

18. The electric heating cable according to claim 13, wherein an edge width of the edge regions on both sides of a central region is 50% to 80% of the total width of the tape.

19. The electric heating cable according to claim 13, wherein the polytetrafluoroethylene tape has a thickness of 40 to 160 μm, which decreases toward the edge regions to 5 μm or less.

20. The electric heating cable according to claim 1, wherein the shock-protecting insulating layer includes a tetrafluoroethylene/perfluoroalkoxy copolymer.

21. The electric heating cable according to claim 1, wherein the shock-protecting insulating layer includes a tetrafluoroethylene/hexafluoropropylene copolymer.

22. The electric heating cable according to claim 1, wherein the shock-protecting insulating layer includes a polytetrafluoroethylene/perfluoromethyl vinyl ether.

23. The electric heating cable according to claim 1, wherein the polytetrafluoroethylene of the sheath is sintered.

* * * * *